United States Patent [19]

Pi-Yu

[11] Patent Number: 4,710,986

[45] Date of Patent: Dec. 8, 1987

[54] OUTLET VALVE FOR TOILET TANK

[76] Inventor: Ou Pi-Yu, No. 9, Alley 2, Ln. 247, Kuang-Chou Rd., Tainan City, Taiwan

[21] Appl. No.: 855,340

[22] Filed: Apr. 24, 1986

[51] Int. Cl.[4] ..... E03D 1/34

[52] U.S. Cl. ..... 4/382

[58] Field of Search ..... 4/381, 382, 383, 384, 4/378, 403, 393

[56] References Cited

U.S. PATENT DOCUMENTS

| | | | |
|---|---|---|---|
| 1,397,208 | 11/1921 | Griffiths | 4/382 |
| 1,952,583 | 3/1934 | Coltman | 4/381 |
| 2,270,989 | 1/1942 | Asselin | 4/382 |
| 2,758,314 | 8/1956 | Granger | 4/403 X |
| 2,819,471 | 1/1958 | Ezzell | 4/382 |
| 3,368,224 | 2/1968 | Ament | 4/393 |
| 4,002,521 | 1/1977 | Schoepe et al. | 4/378 X |
| 4,232,408 | 11/1980 | Chen-Yuan | 4/382 X |
| 4,483,024 | 11/1984 | Troeh | 4/382 X |

*Primary Examiner*—Charles E. Phillips

*Attorney, Agent, or Firm*—Burns, Doane, Swecker & Mathis

[57] ABSTRACT

A floatless outlet valve comprises a valve body having a vertically disposed overflow tube and a valve seat formed integrally at the lower end of the tube. A valve assembly is pivotably connected to the terminal end of the overflow tube by the rear end portion of arm extensions thereby allowing valve of the disc to be closable and operable with respect to the valve port. A cup-like control member with a valve rod is capable of discharging water in the tank completely or partially in accordance with the user's need.

4 Claims, 7 Drawing Figures

OUTLET VALVE FOR TOILET TANK

BACKGROUND AND OBJECTS OF INVENTION

The present invention relates to a toilet tank outlet valve, particularly, a floatless outlet valve for use in both the drainage and the overflow in a toilet tank, which valve being operable in two stages and being easily removable for repair or for a displacement.

It has been found that the conventional outlet valve used in the cistern of a flush toilet consists of an outlet valve, an overflow tube and a control float. Since such an outlet valve lacks a water-saving mechanism, every time when the toilet is flushed, the duration in which the float-controlled valve is open is always the same; hence, no matter whether the toilet is used for evacuation of bowels or for urination, the amount of water that flows down the flush pipe will be the same, that is, water will continue to flow until the cistern is completely drained during one flush. Release of water in this way may sometimes be very wasteful.

Currently, a water-saving mechanism has been developed for use with a toilet tank to save water and already several kinds of commercial products therefor are available on the market. However, because of the complicated construction and high cost in the production of this water-saving mechanism as well as the need for an additional installation of parts or the replacement in whole of the set of inlet and outlet valves in the tank, it has been very inconvenient. Again, the valve adapted to cover the metallic valve seat in the conventional outlet valve is only a rubber valve sheet fixed to a metal sheet. After used for some time, such rubber valve may be worn out easily due to friction with the metal, or the valve port edge itself may be rust-eaten and thus become uneven. In this way, the valve will lose its seal, leading to leakage in the tank causing much waste of water. Although this can be remedied by replacing a new valve sheet for the worn-out one, the installation of a new valve sheet can be accomplished only with the help of tools; the requirement of different tools might present an inconvenience to a family in general. As for the rusting of the edge of the valve port, the only solution thereof may be to replace it with a new outlet pipe connection. Furthermore, in a conventional outlet valve, if the float bowl leaks or is punctured and thus becomes ineffective, or the over-flow pipe becomes rusted, it will be required that the complete set be removed and replaced by a new set. At the same time, the replacement work requires tools and this is also troublesome.

It is the purpose of this invention to ameliorate the afore-said disadvantages in the conventional outlet valve, and to provide a novel outlet valve for use with flushing toilets, which can deliver precise action and can easily be installed in a tank, and by which water saving can thus be effected.

Therefore, the principal object of this invention is to provide for use in tanks an outlet valve having the overflow pipe and valve seat formed integrally, wherein the outlet valve unit can be assembled merely by turning the unit in a positive or negative direction by a small degree without having to rely on any tools.

A further object of this invention is to provide for use in a toilet tank an outlet valve having no attachment whatsoever of a float and a float arm, and as such, the whole structure thereof being substantially compact and small in size, and being further space-saving when installed inside the tank.

A further object of this invention is to provide for use in a toilet tank an outlet valve which by the close association of the cup-like control member with the valve rod is capable of discharging water in the tank completely or partially in accordance with the need of the user so that water saving can be effected.

Another object of the invention is to provide for use in a toilet tank an outlet valve, the overflow tube thereof being open toward the water surface such that outside debris are prevented from falling from the above into the tube to cause blockage therein.

A still another object of the invention is to provide for use in a toilet tank an outlet valve, the expanded rubber valve member used therein being capable of keeping the valve seat always in the sealed condition so that any shortcoming in leakage due to imperfect sealing can thus be prevented.

BRIEF DESCRIPTION OF THE DRAWINGS

Other objects and features of this invention will be apparent from the following detailed description of embodiments accompanied by drawings, in which.

DETAILED DESCRIPTION OF A PREFERRED EMBODIMENT

Figure 1:
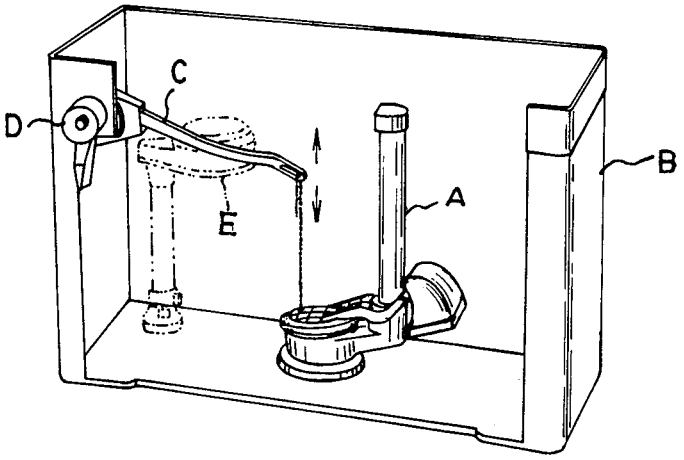
FIG. 1 is a perspective view of a toilet tank installed with an outlet valve of a preferred embodiment according to the invention.

There is shown, in FIG. 1, an outlet valve A of the present invention installed, like a conventional valve, in tank B of a water closet in adaptation for use with an operating lever C and flush handle D. Shown also in the figure is an inlet valve E.

Figure 2:
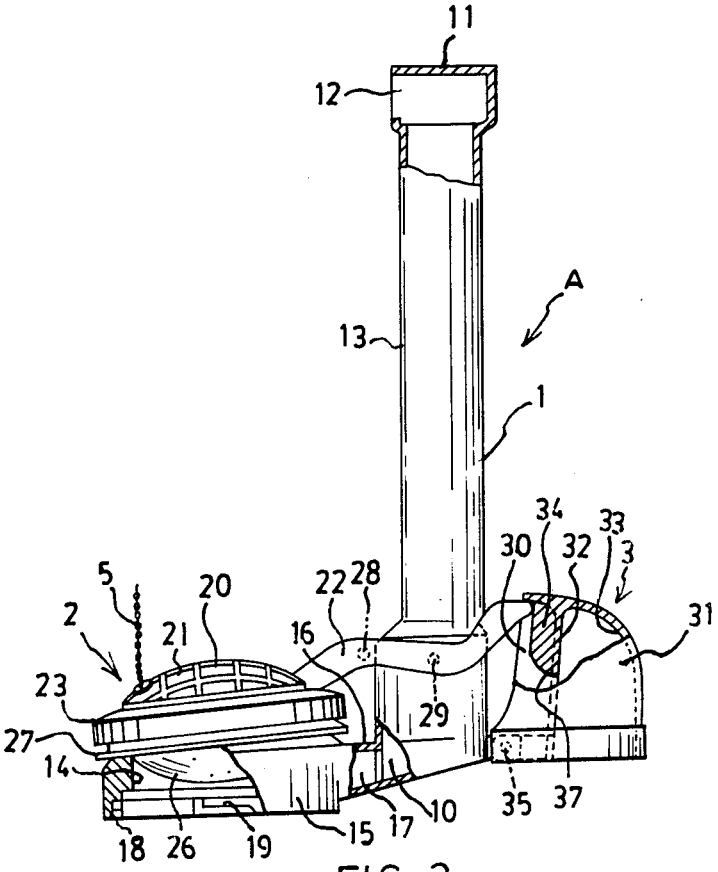
FIG. 2 is a partial section of a side elevational view of the outlet valve shown in FIG. 1.
Figure 3:
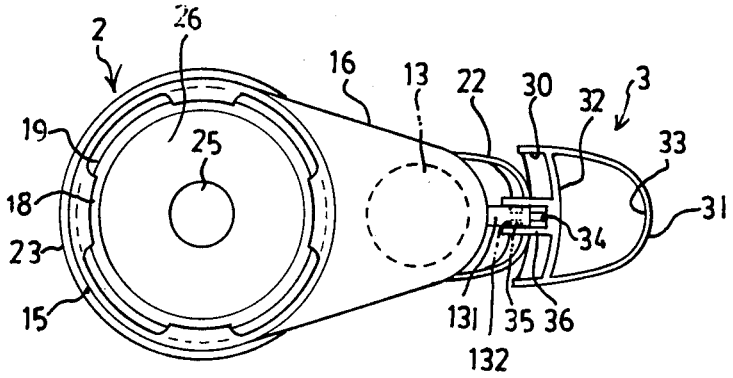
FIG. 3 is a bottom view of the outlet valve shown in FIG. 2.

As depicted in FIG. 2, the outlet valve A of the present invention comprises a valve body 1, a valve assembly 2 which is pivotally connected to the lower part of the valve body 1 and is openable and closable with respect to the valve port, and a controlling means 3 pivotally connected to the lower end of the valve body 1 at the back side of the valve assembly.

The valve body 1 consists of a vertically placed overflow tube 13 being closed at the top 11 and having at one side of the upper end an overflow opening 12. A valve seat 15 is formed integrally at the lower end of the overflow tube 13 and is extended to one side of the tube. The seat 15 forms in a slight L-shape with the overflow tube 13 and is provided with a valve port 14. This port 14 of the valve seat 15 is joined to an opening 10 at the lower end of the overflow tube 13 by a connecting tube 16 and a passage 17. An upper end edge of the port 14 of valve seat 15 is slightly inclined, whereas the lower edge lies in a horizontal plane and the peripheral wall 18 of this lower edge is formed with a plurality of locking channels 19 for connection by being rotated on the outlet tube fitting 4 described hereinbelow.

Figure 4:
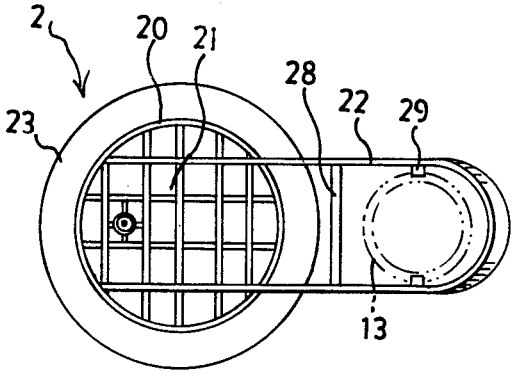
FIG. 4 is a top view of a valve assembly of the outlet valve according to the invention.
Figure 5:
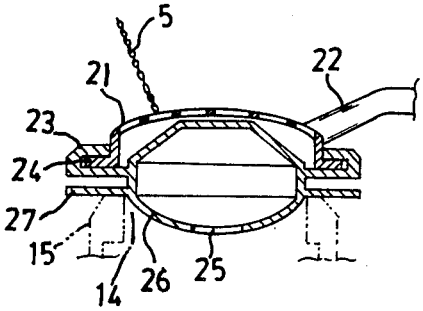
FIG. 5 is a longitudinal sectional view of the main portion of the outlet valve according to the invention.
Figure 6:
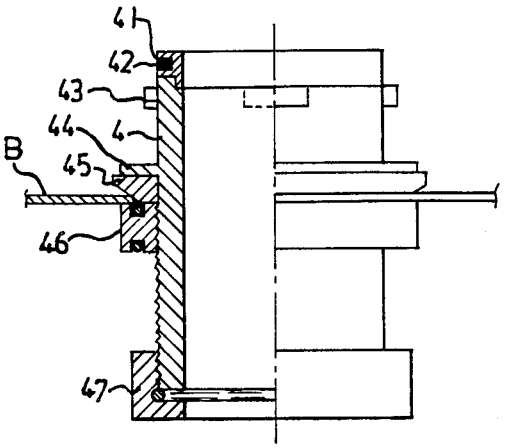
FIG. 6 is a sectional view of a half portion of a pipe connection adapted to be used with the outlet valve of the invention.

The valve assembly 2 comprises a valve supporting means 20 having a front portion formed as an inverted cup-like mesh disk 21 and a rear portion formed as a U-shaped arm 22 which extends backward and upwardly. A gas-bag type valve 26 includes an engaging flange 23 of U-shape cross section formed at the circumference of the valve 26. That flange 23 is firmly engaged on a flange 24 of the above-mentioned disk 21. The valve 26 has a hole 25 in the center. This valve 26 seals over the valve port 14 of said valve seat 15 by means of a sealing flange 27 located beneath the flange 23 mentioned above (see FIG. 5). Close to the disk 21 the U-shaped arm 22 is provided, as shown in FIG. 4, with a stop bar 28. Slightly behind the bar 28 there is mounted on the arm 22 a pair of inwardly projected shafts 29. It is by means of these two projecting shafts 29, which are inserted in a pair of holes formed in the sides of the lower end portion of the overflow tube 13 that the valve assembly 2 can be freely pivoted around an axis defined by said shafts. Attached to the front end portion of the disk 21 is a chain or rope 5 which can be connected at the other end thereof to the operating lever C.

The controlling means 3 of the outlet valve comprises a slightly cap-shaped hollow member 31 closed at its upper side and with the lower side thereof being completely open. This hollow member 31 has a front wall 32 and two side walls 30, 30 extending forward from the two sides of a curved rear wall 33 to project in front of the front wall 32. At the center of that front wall 32 there is provided an upwardly projecting bar 34, whereas in the lower part thereof is formed a pair of projecting arms 36 each carrying a fulcrum pin 35. The fulcrum pins 35 of these projecting arms 36 are each engaged in an opening 132 of a projecting lug 131 formed integrally at the lower end rear wall of the overflow tube 13 thereby providing a fulcrum around which the controlling member 3 can be vertically rotatable.

The toilet tank outlet valve is normally maintained at a closed condition, in which the rear end of the U-shaped arm 22 is in contact with the upper end portion of the projecting bar 34 and the flange 27 of the gas-bag type valve 26 seats against the valve port 14 by its flange 27.

In order that the outlet valve A of the invention can be installed or dismounted in a short time, the bottom of the toilet tank B should include an outlet pipe fitting 4 comprising a peripheral wall formed with a locking projection 43 to be engageable in the afore-said locking channels 19. The fitting 4 also includes a ring groove 41 located above the projection 43; packing 42 is disposed in the groove. By rotating the outlet valve A the locking channel 19 is moved to engage with the locking projection 43. The locking valve A will thus be joined to the pipe fitting 4 through packing 42 in water-tightness. Disconnecting the outlet valve A can be accomplished by merely turning the valve in an opposite direction. The pipe fitting 4 is further provided at the middle portion thereof with a flange 44. Beneath the flange a toilet tank sealing washer 45 is disposed. Under this washer is disposed a nut 46 used for setting the pipe fitting 4 in place on the toilet tank B. At the lowermost end of the fitting a further nut 47 is provided for fitting the outlet pipe 6. In fact, except for the afore-said packing 42 and the locking projection 43 that this pipe fitting 4 must possess at the upper end portion thereof, other portions of the structure the joining part of the pipe fitting with the toilet tank and the pipe fitting to the outlet pipe, any conventional pipe fitting or other kinds of construction can be utilized in the present invention.

Figure 7:
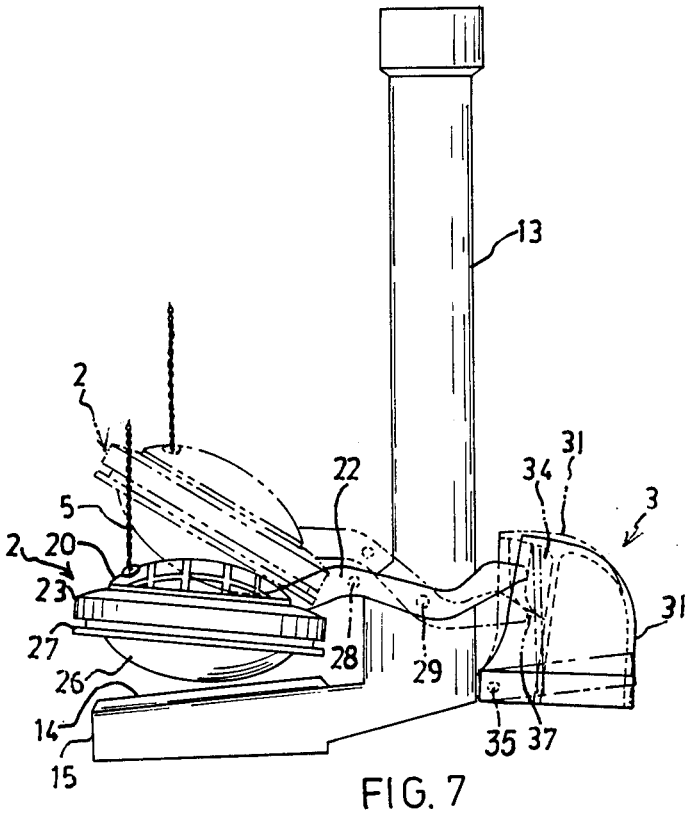
FIG. 7 is a perspective view showing the operation of the outlet valve of the invention.

Owing to the above-mentioned feature, when the toilet tank is permanently fitted with the afore-said pipe fitting 4, the outlet valve A can be mounted and formed into a single body with the fitting 4 by rotating the valve A on the fitting 4. Since there is no need to use any tools in the work, mounting of the outlet valve A of this invention will thus be very easy and convenient. In addition, when the user desires for the purpose of water-saving to release only a small amount of water during flushing, he may do so by operating the two-stage flush handle D via the operating lever C to lift the chain 5 upward to a partial extent. In this way, when the valve 26 is raised up about the pivot shafts 29 to uncover the valve port 14 therebeneath to release water only for as long as the user holds the valve open. Since the free rear end of the arm 22 is still in contact with the front side of the projecting bar 34 of the controlling means 3 as depicted by the imaginary line in FIG. 7, the controlling means will offer slight resistance to the opening of the valve and will be unable to hold the valve open. Furthermore, when the handle D is released, the valve 26, because of its own weight will close the port as it returns to the condition depicted in FIG. 2. However, in the second-stage actuation, the flush handle D is pressed to lift chain 5 up until the terminal end of the arm 22 is moved downwardly about the pivot shaft 29 to extend beneath a stop 37 at the lower part of the projecting bar 34. Then, the body 3 turns in a counter-clockwise direction about the pivot pin 35 as a result of the buoyancy of the body 3 and the self recovery in the equilibrium of its center of gravity. The stop 37 disposed at the lower end of the projecting bar 34 will thus lock the free rear end of the arms 22 thereby holding the valve 2 in a totally open position. Therefore, when the handle D is released, that valve 2 will continue to discharge water until the water level in the tank descends to where the amount of water and the buoyant force inside the central hollow part of the controlling means 3 are no longer sufficient to sustain the equilibrium of gravity of the valve 2. Thus, that valve will automatically close. Hence, according to one's need, a toilet-user may allow the tank to automatically discharge a large amount of water by fully raising the chain, or, he may discharge any appropriate amount of water in accordance with the length of time he presses the flush handle. In this way, it is possible to achieve the purpose of water-saving. As the level of water falls down to where the amount of water in the controlling means 3 has diminished and where water power is no longer sufficient to sustain the equilibrium of gravity of the valve 2, that valve 2 will come down and close the valve port 14 with the concurrent returning of the controlling means 3 to the condition as shown in FIG. 2. Due to the gas-bag shape in which valve 26 is formed and the presence of the double flanges 23, 24, the valve 26 will exhibit flexibility and buffering and will automatically maintain itself in a shape which can be suitably attached to the valve port. Valve seat 15 is formed of plastic, which will stay smooth and rust-free, thereby making it possible to ensure a complete sealing of the valve port while increasing the durability of the valve. Again, as the overflow tube is completely closed at its upper end, there will not be any fear that foreign particles might fall directly into the tube and result in a blockage in said tube. Furthermore, except the chain which is made of stainless steel, the rest of the device can be formed from acid-alkali and chemical resistant plastics and synthetic rubber, and as such it helps in preventing any oxidization and corrosion in the device thereby increasing its life of use. If unexpectedly, the valve 26 becomes broken such that it can no longer be sealed, it is only required that said valve be dismounted and a new valve is substituted and in so doing, since no tools are needed any person can carry out the substitution by himself with great ease. Particularly, if there is trouble with the entire valve unit (the chances of being so are of course very rare), it is necessary only to turn the main valve body slightly in relation to the connecting pipe and dismount it readily. The repaired valve unit or a new unit can also be readily mounted in a similar way and it is not required to hire a plumber nor is there a need to use any special tools; hence the present valve is practically convenient in use.

Although the present invention has been described with reference to a preferred embodiment thereof, various changes and modification can be made by those skilled in the art without departing from the scope of the present invention.

I claim:

1. An outlet valve for use in a toilet tank, comprising:

an outlet valve body having a vertically disposed overflow tube and a valve seat formed integrally at a lower end of said overflow tube said value seat being disposed slightly inclined forwardly and downwardly, said valve seat extending to one side of said overflow tube to form a generally L-shape with said overflow tube and provided with a valve port which communicates with said overflow tube, a valve assembly having a front part formed as an inverted mesh disc and a rear part formed as a valve support means in the form of a U-shaped arm, a gas bag valve being affixed to a lower side of said mesh disc, said valve sealing said valve port from above, and the legs of said U-shaped arm being pivotably connected to a lower end of said overflow tube thereby allowing the valve to be closable and openable with respect to the valve port the base of said U-shaped arm extending freely to the side of the tube opposite said valve seat, actuator means for manually lifting and opening the valve, and a control member comprising a generally cup-shaped hollow body, a front wall thereof being provided with an upwardly projecting bar, said projecting bar including a stop formed adjacent a lower end of said bar, and a lower front end of said control member being pivotably connected to the lower end of said overflow pipe; said valve normally sealing the valve port while said free end of the arm is in contact with an upper portion of the projecting bar of said control means; when the valve is slightly opened upon manual operation said control means is inoperative to hold said valve in the open position; when said valve is completely open said free end of the arm is locked beneath said stop of said control means so that said valve is held in a completely open position until the water level falls to where the control means descends and unlocks the arm to enable the valve to descend upon said valve port.

2. An outlet valve as claimed in claim 1, wherein said overflow tube is closed at the upper end thereof and an overflow opening is provided at an upper end of a front wall of said tube whereas the lower end of said overflow tube is in communication with an underside of the valve port by a connecting tube.

3. An outlet valve as claimed in claim 1, wherein an upper rim of said valve seat is slightly forwardly downwardly inclined, while a circumferential wall at a lower end of said valve port has a locking arrangement whereby said valve seat can be connected by being rotated on a pipe fitting of the toilet tank.

4. An outlet valve as claimed in claim 1, wherein said gas-bag body is open at its lower end and has a circumferential part bent around a flange of the mesh disc-shaped body, and a sealing edge capable of seating on an upper rim of said valve port.

* * * * *